US007637275B2

(12) United States Patent
Stehly et al.

(10) Patent No.: US 7,637,275 B2
(45) Date of Patent: Dec. 29, 2009

(54) TELESCOPIC POST FOR A FOLDING STRUCTURE AND ONE SUCH STRUCTURE

(75) Inventors: Alain Stehly, Charnay (FR); Philippe De Conto, Avanne (FR)

(73) Assignee: VITABRI, Societe Anonyme, Besancon (FR)

( * ) Notice: Subject to any disclaimer, the term of this patent is extended or adjusted under 35 U.S.C. 154(b) by 0 days.

(21) Appl. No.: 12/093,781

(22) PCT Filed: Nov. 14, 2006

(86) PCT No.: PCT/FR2006/051168

§ 371 (c)(1),
(2), (4) Date: Aug. 8, 2008

(87) PCT Pub. No.: WO2007/057604

PCT Pub. Date: May 24, 2007

(65) Prior Publication Data

US 2009/0151763 A1 Jun. 18, 2009

(30) Foreign Application Priority Data

Nov. 18, 2005 (FR) ..... 05 53502

(51) Int. Cl.
*E04H 15/46* (2006.01)

(52) U.S. Cl. ..... 135/139; 135/141; 135/145; 135/114; 248/188.5; 248/364.01; 52/79.5; 52/643

(58) Field of Classification Search ..... 135/121, 135/28, 139–146, 114, 151–153, 903, 912; 52/79.5, 143, 641, 643; 16/30–33, 42 T; 248/346.01, 346.11, 188.1, 188.5, 188.9; 312/265.3

See application file for complete search history.

(56) References Cited

U.S. PATENT DOCUMENTS

| | | | | | |
|---|---|---|---|---|---|
| 1,058,837 | A * | 4/1913 | Zikmund | 16/34 |
| 3,339,321 | A * | 9/1967 | Schmidt | 52/66 |
| 3,526,066 | A * | 9/1970 | Gamble et al. | 52/27 |
| 3,744,500 | A * | 7/1973 | Briggs | 135/140 |
| 4,667,692 | A * | 5/1987 | Tury et al. | 135/156 |
| 4,852,309 | A * | 8/1989 | Stamp, Sr. | 52/79.6 |
| 5,000,211 | A * | 3/1991 | Speare et al. | 135/97 |
| 5,263,507 | A * | 11/1993 | Chuang | 135/140 |
| 5,375,294 | A * | 12/1994 | Garrett | 16/34 |
| 6,361,057 | B1 * | 3/2002 | Carter | 280/63 |
| 6,508,262 | B1 | 1/2003 | Takayama | |
| 6,718,995 | B2 * | 4/2004 | Dotterweich | 135/131 |
| 6,779,538 | B2 * | 8/2004 | Morgante et al. | 135/128 |
| 7,246,779 | B2 * | 7/2007 | Doyle | 248/188.8 |
| 7,380,563 | B2 * | 6/2008 | Seo | 135/145 |
| 7,584,763 | B2 * | 9/2009 | Yoon | 135/131 |
| 2002/0074032 | A1 | 6/2002 | Park et al. | |

* cited by examiner

*Primary Examiner*—Winnie Yip
(74) *Attorney, Agent, or Firm*—Egbert Law Offices PLLC

(57) ABSTRACT

This invention relates to a telescopic post for a folding structure, which can be used to move the structure from a raised deployed position to a folded position, and vice versa. The inventive post includes a lower element which can slide inside an upper element which is solidly connected to the structure. The lower part of the lower element rests on the ground to form a base. The upper element is solidly connected to a movement device, such as caster. The caster projects downward from the base in the folded position, but is withdrawn in the deployed position owing to the vertical movement of the upper element.

8 Claims, 3 Drawing Sheets

TELESCOPIC POST FOR A FOLDING STRUCTURE AND ONE SUCH STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention relates to a telescopic post for a folding structure, capable of passing from a raised deployed position of said structure to a folded position, and vice versa, said post including a lower element sliding inside an upper element integral with said structure, said lower element resting on the ground in its lower part forming a base.

This invention falls into the field of knockdown or folding structures designed to be used as a shelter.

2. Description of Related Art Including Information Disclosed Under 37 CFR 1.97 and 37 CFR 1.98.

Such a shelter is generally formed of a metallic structure covered at least in its upper part by a covering element forming a roof. This shelter is, mostly, in its deployed position, in the form of a tent having the shape of a cube surmounted by a pyramid.

This type of shelter is designed for a specific use, as a stand or similar, over a determined period of time, requiring then an assembly and a dismantlement both simple and quick. This is why the existing shelters have been designed unfolding, passing from a folded configuration, for their transportation and their storage, to a deployed position, or vice versa. This possibility to fold and unfold the shelter greatly facilitates its assembly in comparison with shelters including a structure formed of side members, rods or bars that are removable and made integral with each other by fastening elements.

A folding shelter includes a structure generally formed of side members made of a metallic material, for example profile bars made of aluminum or of aluminum compound. Said side members are articulated between each other so as to allow the passage of said shelter from one folded position to a deployed configuration, or vice versa.

In addition, the covering element is secured to said structure so that the folding or the unfolding of the shelter does not require the removal of said covering element. For this purpose, the latter is made in the form of a tarpaulin made of plastic—flexible and watertight—fixed to said structure.

However, existing folding shelters are limited in size because of the load-bearing capacity of the structure and the weight that the articulated side members support, as well as the total mass of the structure. Existing shelters generally have a maximum surface of 3×3 meters on the ground. For more significant surfaces, one should then recur to classical knockdown shelters.

In addition, the structure of existing shelters includes, at each of its corners, vertical telescopic posts so as to, in one direction, raise said structure and the covering means in the deployed position and, in the other direction, permit the lowering of the structure so as to make it more compact in the folded position. Each vertical post includes a lower element resting on the ground through a base and sliding inside an upper element integral with said structure. For this reason, the lower element is of a smaller cross-section than the upper element, posing in particular problems regarding the rigidity of the whole.

Another disadvantage resides in the movement of said shelter during its assembly, in particular after the unfolding of the structure but before raising. Casters—removable or not—are generally placed under the base of a post for positioning the whole according to preferences. Once the shelter positioned, it is necessary to withdraw or retract said casters, involving lifting the weight of the entire structure.

BRIEF SUMMARY OF THE INVENTION

The object of the invention is to cope with the disadvantages of the state of the art by proposing a folding structure constituting a shelter equipped with telescopic posts solidifying the entire structure and improving its foundation as well as permitting an easy positioning of the shelter with a view to its raising.

In addition, in the folded position, the structure is compacted rigidly and securely, still offering easy handling.

Another advantage of the structure according to the invention resides in that it can have greater dimensions, of a large size, in order to bring an alternative to the utilization of knockdown structures.

For this purpose, the invention relates to a telescopic post for a folding structure, capable of passing from a raised deployed position of said structure to a folded position, and vice versa, said post including a lower element sliding inside an upper element integral with said structure, said lower element resting on the ground in its lower part forming a base.

Such a post is characterized in that said upper element is integral with the movement means, in particular at least one caster, so that said caster emerges below said base in the folded position whereas it is withdrawn in the deployed position under the action of the vertical movement of said upper element.

According to other characteristics of the invention, the base includes a recess made so as to permit the projection—in its entirety or partially—of said caster under said base.

Advantageously, said post includes means for reinforcing the foundation of said post in the form of a plate comprising two wings extending substantially orthogonally with respect to each other, the lower end of said plate being integral with said base whereas the upper end slides along the upper element.

In addition, a wing of a post includes means for fastening the edges of a linking panel to at least another post.

Preferably, a wing of a post includes means for anchoring a barrier designed to constitute a wall to said shelter.

According to an embodiment, said upper element is made so as to co-operate by sliding with the lower element having a substantially hexagonal section.

Advantageously, the upper element includes, over its entire length or part thereof, guiding means, such as a slideway capable of cooperating with rolling means integral with and articulated to said structure.

The invention also relates to a folding structure forming a shelter equipped with foundation means in the form of such telescopic posts.

According to another characteristic of the structure, in the folded position, the posts are fixed between each other two by two through a linking panel.

Other features and advantages of the invention will become clear from the following detailed description of the non-restrictive embodiments of the invention, with reference to the figures attached hereto.

DETAILED DESCRIPTION OF THE INVENTION

Figure 1:
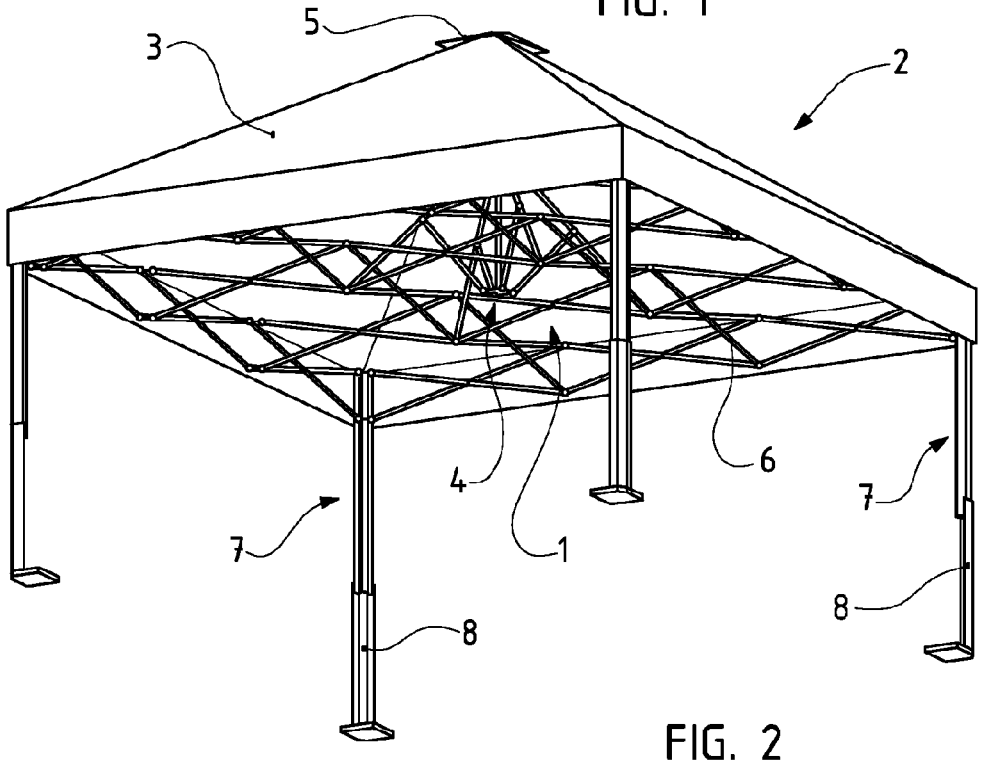
FIG. 1 represents a bottom perspective view of a structure according to the invention in the deployed position.
Figure 2:
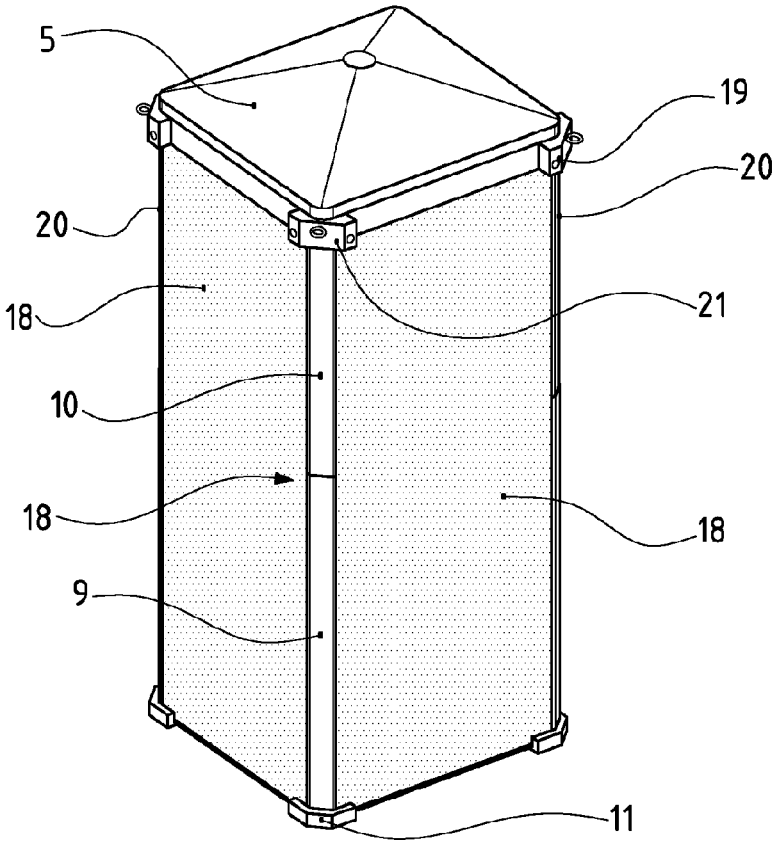
FIG. 2 is a perspective view of a representation of the structure in the folded position for storage or for transportation.

This invention relates to a folding structure 1, capable of passing from a folded position for storage or transportation to a deployed position, or vice versa, and designed to form a shelter 2 in the deployed position. The two positions—deployed and folded—are shown in FIGS. 1 and 2, respectively.

This shelter 2 includes covering means 3 integral with said structure 1 so as to withdraw along the latter during the withdrawal of said shelter 2. Said covering means 3 can advantageously be in the form of a tarpaulin having a simple or double curvature, made out of a plastic compound or of any other material. Said tarpaulin is put under lateral tension by the unfolding of the structure 1. In addition, a central pole 4 puts said tarpaulin under vertical tension. Said pole can advantageously be installed in the form of a cam, so as to ascend or descend under the rotating action of a crank, not shown. Under tension, the covering means 3 form a substantially pyramidal roof. Said roof can be crowned by a cap 5 integral with the upper end of said pole 4.

The structure 1 includes side members 6 articulated between each other so as to form a mesh permitting its folding/unfolding. Said side members 6 are movable in the manner of accordions to permit them to move apart or bring them closer, the extension or contraction of said side members 6 being carried out transversally in a horizontal plane.

The structure 1 also includes foundation means 7 arranged on the periphery and capable of permitting the support of said shelter 2 on the ground. Said foundation means 7 are in the form of vertical posts 8.

It should be noted that the surface on the ground defined by the shelter 2 can be in the form of a polygon, in particular a regular polygon, such as a square, a hexagon or similar.

A post 8 is telescopic, thus being capable of passing from a raised deployed position of said structure 1 to a folded position, and vice versa. Said post 8 includes a lower element 9 sliding inside an upper element 10 integral with said structure. Said lower element 9 rests on the ground in its lower part forming a base 11.

Figure 4:
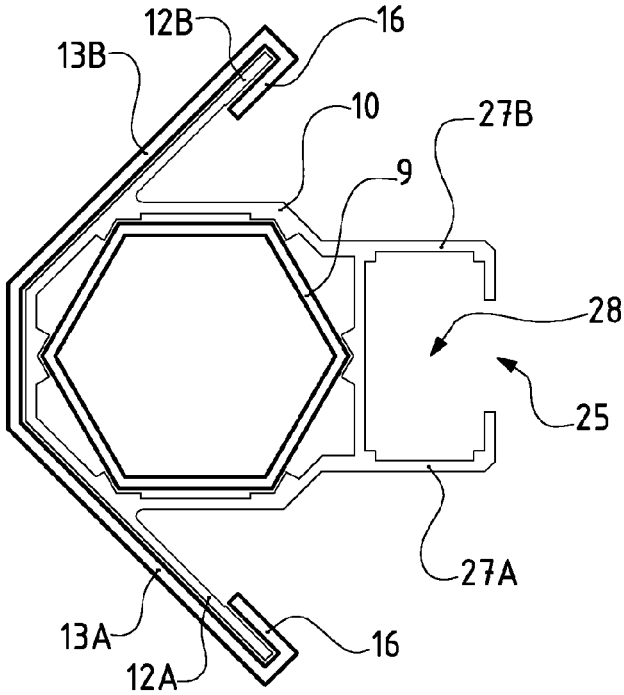
FIG. 4 is a cross-sectional view of the post of FIG. 3.

The lower element 8 of a post 8 is formed of a metallic profile bar having a substantially hexagonal shape, the upper element 10 having a cross-section of a shape that is complementary to the shape of said lower element 8, as shown in FIG. 4. Said upper element 10 is therefore made so as to cooperate by sliding with the lower element 9 having a substantially hexagonal cross-section.

Figure 3:
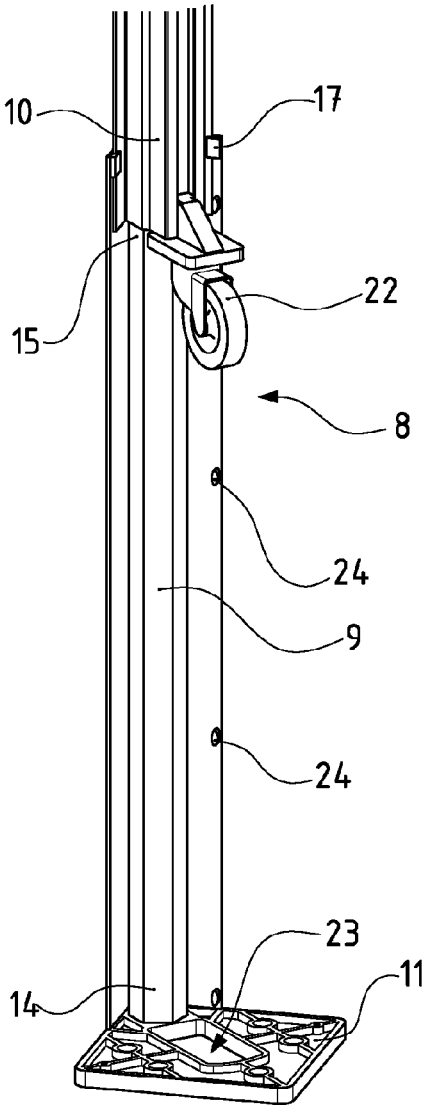
FIG. 3 is a perspective view of a post according to the invention in the raising position.

In particular, the upper element 10 includes lateral wings 12A, 12B extending substantially orthogonally with respect to each other. Said wings 12A, 12B serve as a reinforcement to said post 8 and also as slideways to the means for reinforcing the foundation of said post 8. The latter are in the form of a plate comprising two wings 13A, 13B extending substantially orthogonally with respect to each other, the lower end 14 of said plate being integral with said base 11 whereas the upper end 15 slides along the upper element 10, in particular along the wings 12A, 12B. For this purpose, the lateral edges of the wings 12A, 12B can have a double bending 16 inwards so as to surround the edge of the wings 13A, 13B. This bending can be continuous or discontinuous, extending entirely or partially over the edge of the wings 12A, 12B. According to the preferred embodiment of the invention, shown in FIG. 3, the wings 12A, 12B can also be provided with fastening means 17 capable of sliding along the edges of the wings 13A, 13B.

In addition, the wings 13A, 13B cover at least partially the wings 12A, 12B in the folded position, as shown in FIG. 2. In this configuration, a linking panel 18 between two contiguous posts 8 permits to interlock the whole of the structure 1 in the folded position, facilitating transportation and handling, as well as storage, permitting the piling up of several structures 1. In addition, the linking panel 18 protects the structure 1 in its folded position. Finally, it can serve as information carrier, in particular of the advertising type, for example regarding the event or the seller, producer or renter of said structure 1. Each post 8 includes means for fastening 19 the edges 20 of such a linking panel 18. Said fastening means 19 can be arranged on the wings 13A, 13B; preferably, they are arranged on corner pieces 21 arranged at each end of each post 8. Said corner pieces 21 can also be used for the piling up of folded structures 1 but can advantageously be designed projecting with respect to the edges of said structures 1 so as to protect it from impacts during its transportation. For example, said corner pieces 21 can be made out of a flexible or semi-rigid plastic material.

Each wing 13A, 13B also includes means for anchoring 24, not shown, a barrier designed to constitute a wall to said shelter 2. This barrier can be formed of a tarpaulin made out of any material, preferably made out of the same material as the tarpaulin of the covering means 3. The anchoring means 24 can be arranged at regular intervals along said wings 13A, 13B.

Preferably, the upper element 10 also includes, over its entire length or part thereof, means 25 capable of guiding the side members 6 of the structure 1 during unfolding and folding operations. For this purpose, the profile bar forming the upper element 10 includes said guiding means 25 in the form of a slideway 26. Shown in particular in FIG. 4, said slideway 26 is located inside the post 8 and is comprised of two extensions 27A, 27B substantially parallel with respect to each other. The space 28 thus formed between the extensions 27A, 27B is made so as to cooperate with rolling means 29 integral with the ends 30 of the side members 6 of said structure 1.

Figure 6:
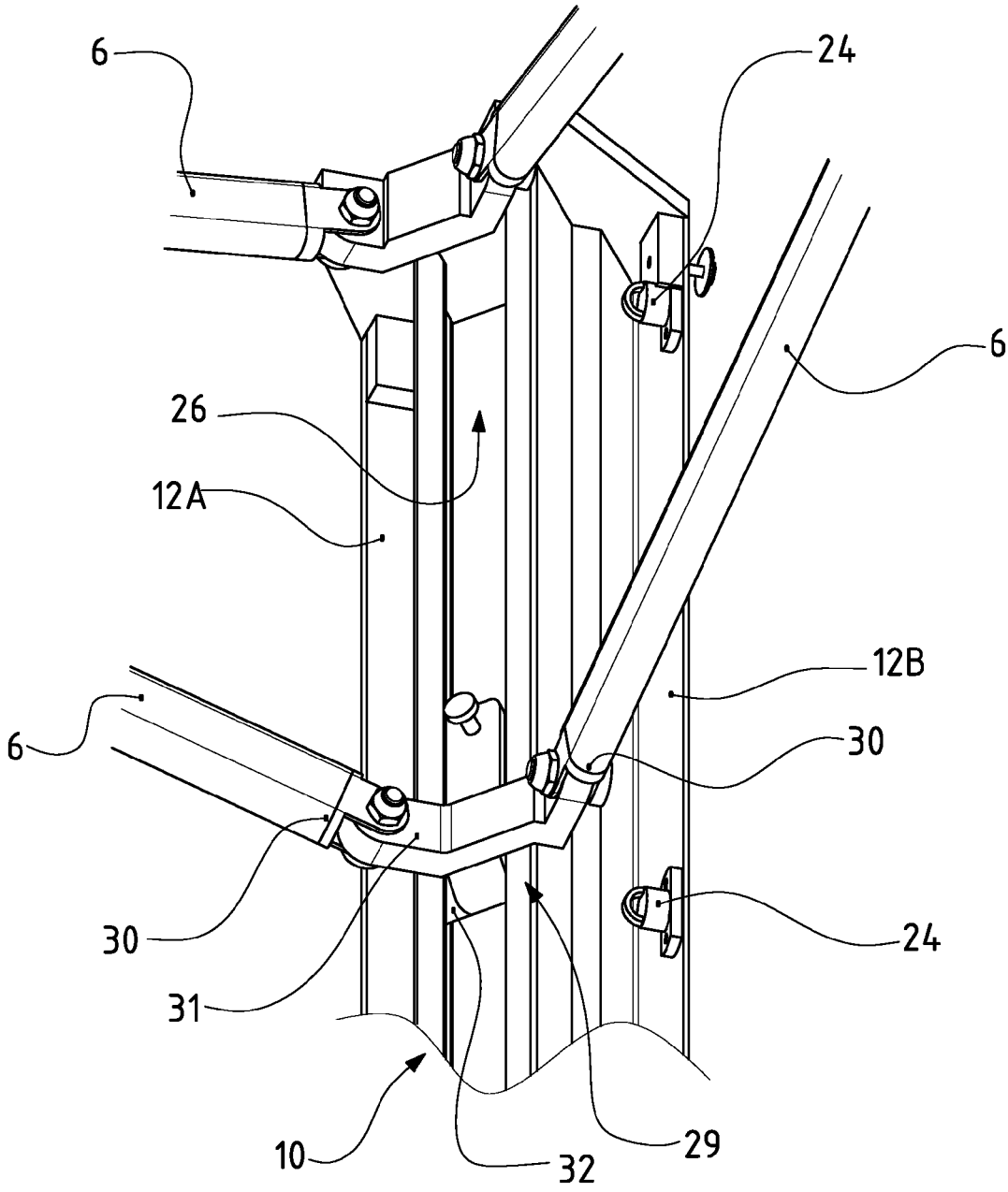
FIG. 6 is a perspective view of another part of the post according to the invention.

Said rolling means 29, shown in particular in FIG. 6, include a carriage 31 on which are installed, in an articulated manner, the ends 30 of the side members 6. Said carriage slides within said slideway 26 through at least two wheels 32 placed internally and substantially parallel to the extensions 27A, 27B. During unfolding or folding of the structure 1, the wheels 32 slide along the slideway 26, avoiding any resistance and greatly facilitating the passage from one position to another.

In addition, the slideway 26 can serve as a support to lighting kits, electric supply kits, heating kits or similar. For this purpose, said kits can fit together inside the guiding means 25 and include means for blocking said slideway 26 at various levels.

Figure 5:
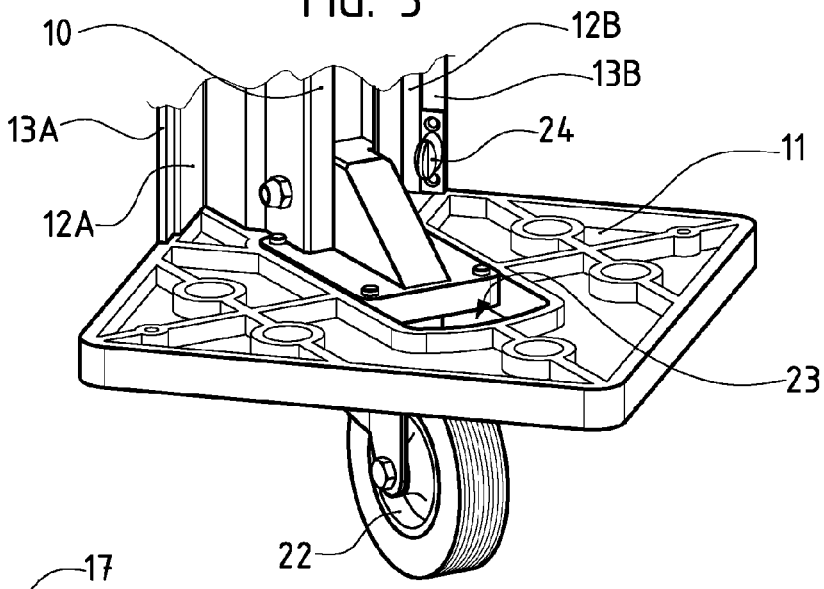
FIG. 5 is a top perspective view of a part of said post.

Another advantageous feature of the invention resides in that said upper element 10 is integral with movement means, in particular at least one caster 22, so that said caster 22 emerges below said base 11 in the folded position whereas it is withdrawn in the deployed position under the action of the vertical movement of said upper element 10. Thus, in the folded position of a post 8, the caster 22 raises the base 11 and rests on the ground. According to the embodiment shown in FIGS. 4 and 5, the base 11 can be made so as to permit the entire or partial projection of said caster 22. In particular, the base 11 can include a recess 23 for receiving said caster 22.

For this purpose, said caster 22 can be fixed in a removable way on said upper element 10 of a post 8. In the position for raising the post 8, said caster 22 can serve as a support to an independent element, such as a partition, a post, a bar or similar.

The caster 22 can also serve as a limit stop of the carriage 31 of the rolling means 29. As a matter of fact, during its movement in the structure folding stage 1, the carriage is blocked in the lower portion of said upper element 10 by said caster 22.

It should be noted that the base 11 is fixed at the lower end 14 of the lower element 9 of a post 8. It can be in the form of a plate so as to increase the supporting surface of a post 8 on the ground. In particular, the bases 11 of each post 8 cover the entirety of the bottom of the structure 1 in the folded position.

Likewise, the cap 5 covers the entirety of the top of the structure 1 in the folded position. Thus, in this position, the structure 1 is entirely enclosed and protected for its transportation and storage.

The invention also relates to a folding structure 1 for a shelter 2, capable of passing from a deployed position constituting said shelter 2 to a folded position, and vice versa, and including integral covering means 3 as well as telescopic foundation means 7 capable of raising said structure 1. Such a structure 1 is characterized in that said foundation means 7 are in the form of at least one of the posts 8 as described above.

Of course, the invention is not limited to the examples illustrated and described above, which can have variants and modifications without however departing from the scope of the invention.

We claim:

1. A telescopic post for a folding structure, said folding structure having a raised deployed position and a folded position, said telescopic post comprising:

a lower element;

an upper element, being integral with said folding structure, said lower element sliding into said upper element and having a lower part rested on ground, said lower part forming a base;

movement means, being integral with said upper element, said movement means being a caster, said caster emerging below said base in the folded position and being withdrawn in the deployed position by action of vertical movement of said upper element; and guiding means, being mounted along a length of said upper element, said guiding means being a slideway cooperative with a rolling means integral with and articulated to said folding structure.

2. The post, according to claim 1, wherein said base has a recess, said caster being projected from under said base from said recess.

3. The post, according to claim 1, further comprising:

means for reinforcing said base, said means for reinforcing said base comprising a plate with two wings extending substantially orthogonally with respect to each other, said plate having a lower end being integral with said base and an upper end slidable along said upper element.

4. The post, according to claim 3, wherein each wing is comprised of a means for fastening edges of a linking panel to at least another post.

5. The post, according to claim 3, wherein each wing is comprised of a means for anchoring a barrier, said barrier forming a wall to a shelter.

6. The post, according to claim 1, wherein said upper element is cooperative with said lower element by sliding, said upper element having a substantially hexagonal section.

7. A folding structure for a shelter, having a deployed position forming said shelter and a folded position, said folding structure comprising:

an integral covering means;

a telescopic foundation means, raising said integral covering means with said shelter and being comprised of a post, according to claim 1.

8. The folding structure, according to claim 7, wherein said post is fixed to another post, two by two through a linking panel, in said folded position.

* * * * *